US011459205B2

(12) United States Patent
Roussel

(10) Patent No.: US 11,459,205 B2
(45) Date of Patent: Oct. 4, 2022

(54) CORRUGATED CABLE DISPENSER

(71) Applicant: Belden Inc., St. Louis, MO (US)

(72) Inventor: Wayne Roussel, Mooreland, IN (US)

(73) Assignee: BELDEN, INC, St. Louis, MO (US)

( * ) Notice: Subject to any disclaimer, the term of this patent is extended or adjusted under 35 U.S.C. 154(b) by 797 days.

(21) Appl. No.: 16/037,691

(22) Filed: Jul. 17, 2018

(65) Prior Publication Data

US 2019/0023521 A1 Jan. 24, 2019

Related U.S. Application Data

(60) Provisional application No. 62/535,670, filed on Jul. 21, 2017.

(51) Int. Cl.

*B65H 49/32* (2006.01)
*B65H 75/22* (2006.01)
*B65D 85/04* (2006.01)

(52) U.S. Cl.

CPC ..... *B65H 49/322* (2013.01); *B65D 85/04* (2013.01); *B65H 49/321* (2013.01); *B65H 75/22* (2013.01); *B65H 2701/34* (2013.01); *B65H 2701/5112* (2013.01)

(58) Field of Classification Search

CPC .... B65H 49/322; B65H 49/321; B65H 75/22; B65H 49/08; B65D 85/04; B65D 85/876; B65D 83/0481; B65D 83/0805; B65D 83/0804; B65D 5/16; B65D 5/323; B65D 5/18

USPC .... 206/395, 702, 225–6, 389, 392; 242/149; 229/122, 122.21, 122.23, 103.2

See application file for complete search history.

(56) References Cited

U.S. PATENT DOCUMENTS 4,168,778 A * 9/1979 Buxton ..... B65D 85/676 206/397
5,529,186 A * 6/1996 Bass ..... B65H 49/322 206/395
5,704,479 A * 1/1998 Barnett ..... B65H 49/322 206/416
6,276,623 B1 * 8/2001 Williams ..... B65H 49/322 206/395
6,805,239 B2 * 10/2004 Smarr ..... B65D 85/66 206/397
6,896,424 B2 * 5/2005 Hara ..... G03C 3/00 206/397
8,662,433 B2 * 3/2014 Huffman ..... B65D 5/16 242/171

(Continued)

*Primary Examiner* — Rafael A Ortiz
*Assistant Examiner* — Sanjidul Islam
(74) *Attorney, Agent, or Firm* — Foley & Lardner LLP

(57) ABSTRACT

The present disclosure describes methods of manufacture and implementations of cable storage and dispensing systems combining the advantages of reel-based systems and box-based systems. The present system may be manufactured entirely out of corrugated cardboard or similar materials, reducing expense and weight compared to systems with wood, plastic, or metal reels or flanges, and adding recyclability in a single paper-based waste stream. The system may dispense cable in the same manner as reel-based systems, reducing tangling and aiding installation and deployment compared to box-based systems that do not utilize reels or spools. The system does not require the use of reel stands or other external components, and may be light and portable.

18 Claims, 9 Drawing Sheets

(56) References Cited

U.S. PATENT DOCUMENTS

| | | | | |
|---|---|---|---|---|
| 2002/0088896 | A1* | 7/2002 | Gordon | B65H 75/22 242/610.2 |
| 2002/0125161 | A1* | 9/2002 | Cote | B65D 85/04 206/408 |
| 2004/0102870 | A1* | 5/2004 | Andersen | G06K 7/10336 700/215 |
| 2008/0236102 | A1* | 10/2008 | Murakami | B65B 25/146 53/405 |
| 2012/0318939 | A1* | 12/2012 | Galgano | B65H 49/325 248/127 |
| 2013/0292284 | A1* | 11/2013 | Burke | B65D 85/672 493/391 |
| 2014/0263815 | A1* | 9/2014 | LaFontaine | B65H 49/322 242/594.5 |
| 2015/0203324 | A1* | 7/2015 | Meachum | B65H 49/205 242/588.6 |
| 2017/0320689 | A1* | 11/2017 | Ellis | B65H 49/325 |

* cited by examiner

CORRUGATED CABLE DISPENSER

RELATED APPLICATIONS

The present application claims the benefit of and priority to U.S. Provisional Application No. 62/535,670, entitled "Corrugated Cable Dispenser," filed Jul. 21, 2017, the entirety of which is incorporated by reference herein.

FIELD

The present application relates to storage and deployment systems for wire and cable. In particular, the present application relates to a corrugated cardboard cable dispensing system.

BACKGROUND

Cable and wire are typically stored and deployed from reels, spools, or boxes, or various combinations of reels and boxes. For example, cable may be helically wound onto a wooden or plastic spool, and unwound during deployment or installation, reducing the potential for tangling. In other implementations, cable may be stored in a box, such as a cardboard box, in a coil. The cable may be coiled around a central tube integrated into the box, with one end of the cable fed through the tube to an exterior of the box. Via this free end, the cable may be pulled from the coil, reducing the potential for tangling.

Cable storage and dispensing systems utilizing reels or spools typically require reel stands or other axle mechanisms to allow the reel or spool to freely rotate during deployment, adding expense and weight and reducing portability of the system. Conversely, cable dispensing systems using a box without a reel or spool may be lightweight and inexpensive, but may be more prone to tangling than reel or spool-based systems.

SUMMARY

The present disclosure describes methods of manufacture and implementations of cable storage and dispensing systems combining the advantages of reel-based systems and box-based systems. The present system may be manufactured entirely out of corrugated cardboard or similar materials, reducing expense and weight compared to systems with wood, plastic, or metal reels or flanges, and adding recyclability in a single paper-based waste stream. The system may dispense cable in the same manner as reel-based systems, reducing tangling and aiding installation and deployment compared to box-based systems that do not utilize reels or spools. The system does not require the use of reel stands or other external components, and may be light and portable.

BRIEF DESCRIPTION OF THE FIGURES

In the drawings, like reference numbers generally indicate identical, functionally similar, and/or structurally similar elements.

DETAILED DESCRIPTION

Cable and wire are typically stored and deployed from reels, spools, or boxes, or various combinations of reels and boxes. For example, cable may be helically wound onto a wooden or plastic spool, and unwound during deployment or installation, reducing the potential for tangling. In other implementations, cable may be stored in a box, such as a cardboard box, in a coil. The cable may be coiled around a central core or tube integrated into the box, with one end of the cable fed through the tube to an exterior of the box. Via this free end, the cable may be pulled from the coil, reducing the potential for tangling.

Cable storage and dispensing systems utilizing reels or spools typically require reel stands or other axle mechanisms to allow the reel or spool to freely rotate during deployment, adding expense and weight and reducing portability of the system. Conversely, cable dispensing systems using a box without a reel or spool may be lightweight and inexpensive, but may be more prone to tangling than reel or spool-based systems.

Instead, the present disclosure describes methods of manufacture and implementations of cable storage and dispensing systems combining the advantages of reel-based systems and box-based systems. The present system may be manufactured entirely out of corrugated cardboard or similar materials, reducing expense and weight compared to systems with wood or metal reels or flanges, and adding recyclability in a single paper-based waste stream. The system may dispense cable in the same manner as reel-based systems, reducing tangling and aiding installation and deployment compared to box-based systems that do not utilize reels or spools. The system does not require the use of reel stands or other external components, and may be light and portable. Although referred to generally as a corrugated cable dispenser, in many implementations, the cable dispenser may be made out of other materials, such as paperboard, kraft board, fiberboard, compressed paper, paper-adhesive composites, wood, plastic, metal, carbon-fiber, or any other such materials or combinations of materials.

Figure 1A:
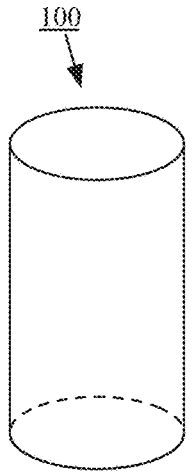
FIG. 1A is an illustration of an embodiment of a core of a corrugated cable dispenser.

The cable dispensing system discussed herein may comprise a core 100, as shown in FIG. 1A, illustrating of an embodiment of a core 100 of a cable dispenser. The core 100 may comprise a tube or cylindrical core of any suitable thickness and diameter, such as ⅛" thick, ¼" thick, ½" thick, or any other such thickness; and 2" diameter, 3" diameter, 4" diameter, 6" diameter, or any other such diameter. The tube may be solid or hollow, in various embodiments. The tube may be constructed from compressed paper, corrugated cardboard, paper-adhesive composites, kraft paper, paperboard, fiberboard, plastic, metal, or any other type and form of material. In some implementations, paper or cardboard may be used to provide easy or single-stream recyclability, as well as reducing weight. The core may be wrapped in or hold a coil of cable, discussed in more detail below, and may be supported by a frame, similarly discussed in more detail below. The core may be formed via any suitable means, including cutting portions out of a larger tube, including spiral-wound, steam compressed, or otherwise formed. In some implementations, the core may comprise a plurality of layers, as in a multiply wound spiral tube.

Figure 1B:
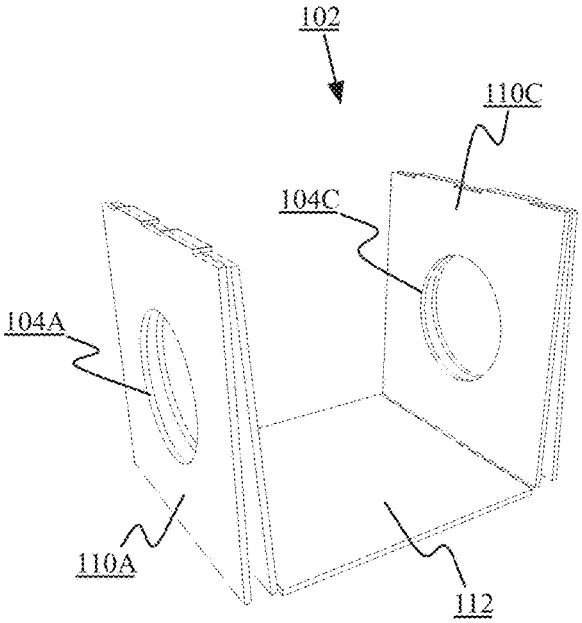
FIG. 1B is an illustration of an embodiment of a frame of a corrugated cable dispenser, folded for use.

FIG. 1B is an illustration of an embodiment of a frame 102 of a cable dispenser, folded for use. In some implementations, the frame 102 may comprise a plurality of panels 110A-110D, which may have similar dimensions (e.g. height, weight, and depth). Panels 110A-110D, sometimes referred to as panel(s) 110, side panel(s) 110, or supporting panel(s) 110, may include a corresponding hole or aperture 104A-104D, sometimes referred to as hole(s) 104 or core supporter(s) 104. The inner diameter of hole(s) 104 may be approximately equal to (or very slightly larger) than an outer diameter of core 100, such that the core 100 may be inserted through and supported by hole(s) 104, with a sufficiently low friction such that core 100 may rotate. In some implementations, a difference between the inner diameter of hole(s) 104 and outer diameter of core 100 may be ⅛", 1/16", 1/32", 1 mm, 0.5 mm, or any other such value. In many manufacturing implementations, hole(s) 104 may be cut from panel(s) 110 via a die cutting operation, laser cutting operation, or similar operation.

In the implementation shown, frame 102 may comprise four panels 110A-110D, with panels 110A and 110B folded to be adjacent, and panels 110C and 110D folded to be adjacent. This may provide additional strength to support core 100. Each panel may be attached to at least one other panel by an edge, discussed in more detail below. Panels 110A-110B and 110C-110D may be attached to and separated by a base panel 112. Base panel 112 may be similar to panels 110A-110D in many implementations, though may not necessarily include a hole 104. Base panel 112 may provide lateral strength to frame 102.

Figure 1C:
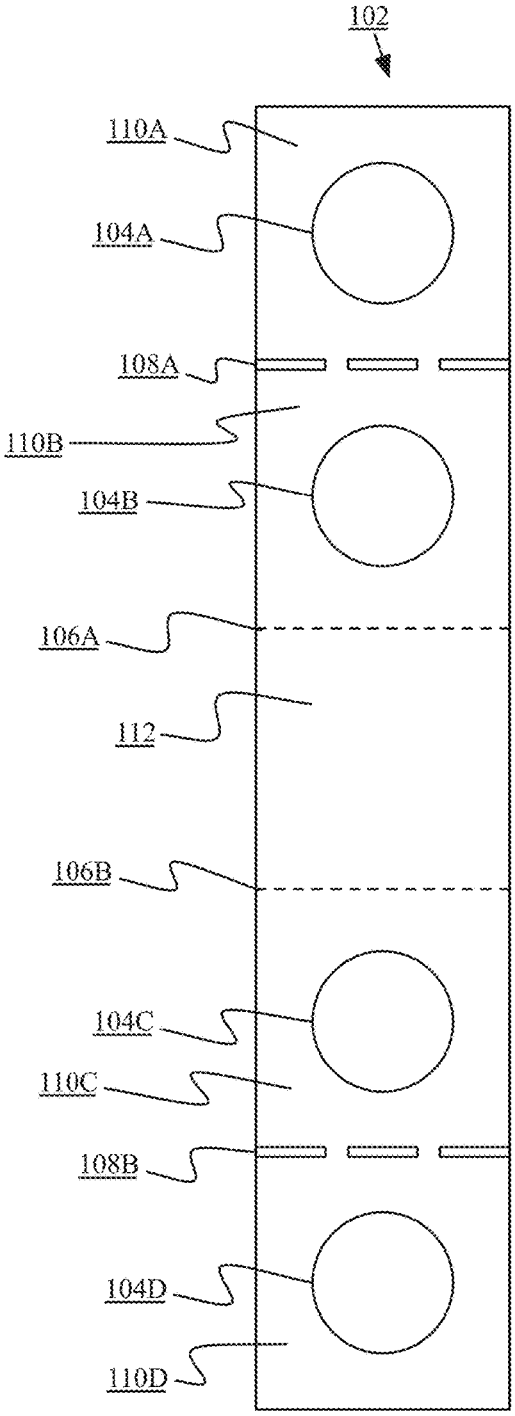
FIG. 1C is an illustration of an embodiment of the frame of the corrugated cable dispenser of FIG. 1B, unfolded.

FIG. 1C is an illustration of an embodiment of the frame 102 of the corrugated cable dispenser of FIG. 1B, unfolded. As shown, each of panels 110A-110D and 112 may be attached by opposing edges so as to form a line. In other implementations, panels may be attached by orthogonal edges. In many implementations, frame 102 may be manufactured as a continuous or semi-continuous strip of material (e.g. corrugated cardboard, paperboard, kraft board, fiber board, etc.). Holes 104A-104D may be cut in the strip of material during manufacture, e.g. via a die cutting or laser cutting process. To facilitate bending of the strip such that panel 110A and 110B are adjacent with holes 104A-104B aligned as shown in FIG. 1B (and such that panel 110C and 110D are adjacent with holes 104C-104D aligned as shown in FIG. 1B), in some implementations, hinges 108A-108B may be cut in the strip. Hinges 108A-108B may comprise one or more cutouts such that the strip may be easily bent to a near-180 degree angle (typically within the range of 170-179 degrees) at the hinge in order to align corresponding holes 104. Although shown as three cutouts and two attachment portions, in many implementations, hinge(s) 108 may comprise one cutout, two cutouts, three cutouts, four cutouts, or any other such number of cutouts; and corresponding two, three, four, five, or any other number of attachment portions. In some implementations, rather than utilizing explicit cutouts, hinge(s) 108 may be perforated to reduce structural strength and facilitate bending.

During manufacture, the strip may be folded at portions 106A-106B, sometimes referred to as fold(s) 106, on either side of base panel 112. Folds 106 may be simply folded, or may comprise cutouts or perforations, as with hinge(s) 108.

Figure 1D:
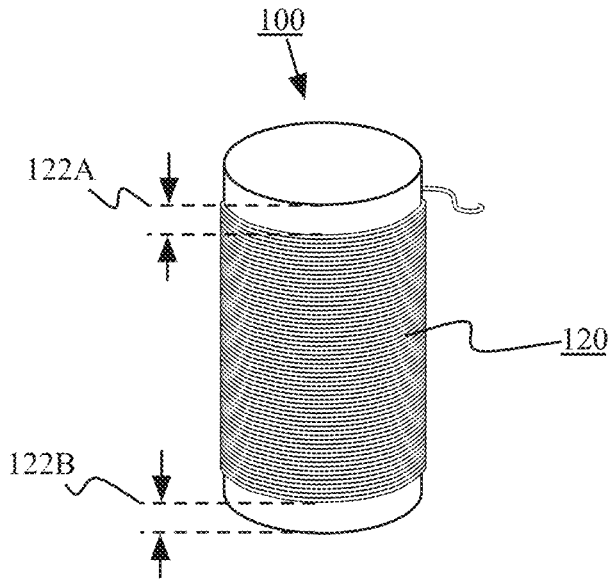
FIG. 1D is an illustration of an embodiment of the core of the corrugated cable dispenser of FIG. 1C holding a cable for storage or deployment.

FIG. 1D is an illustration of an embodiment of the core 100 of the corrugated cable dispenser of FIG. 1C holding a cable 120 for storage or deployment. The cable 120 may be wrapped on to core 100 in a spiral or helical fashion, and may comprise multiple layers or wraps (e.g. for longer cables). Although referred to as a cable, cable 120 may comprise any type and form of rope, wire, cable, or similar material, such as single conductor wire, multi-conductor wire (e.g. electrical wire, coaxial cable, serial data cable, audio cable, speaker wire, etc.), multi-pair wire (e.g. Cat5, Cat5e, Cat6, etc.), rope (e.g. nylon, hemp, polymer, etc.), chain (plastic, metal, etc.), or other such material, without limitation. In some implementations, one end of the cable 120 may be attached to core 100, e.g. via glue or insertion into a cutout in the core (not illustrated). In other implementations, the cable 120 may be held to the core by friction (e.g. via multiple layers of wrappings of the cable).

The cable 120 may be constrained to a central portion of the core 100, such that regions 122A-122B at either terminal portion of the core are not covered by the cable 120 or are free from the cable. Regions 122A-122B may be referred to variously as axle region(s) 122, free region(s) 122, or by other such names. In many implementations, a plurality of cables 120 may be wound onto an extended core, with portions 122 between each cable 120, and the extended core subsequently cut or divided into individual cores 100 with terminating portions 122. This may increase manufacturing efficiency by only requiring a single cable winding machine or apparatus for a plurality of simultaneously manufactured cable dispensers.

Figure 1E:
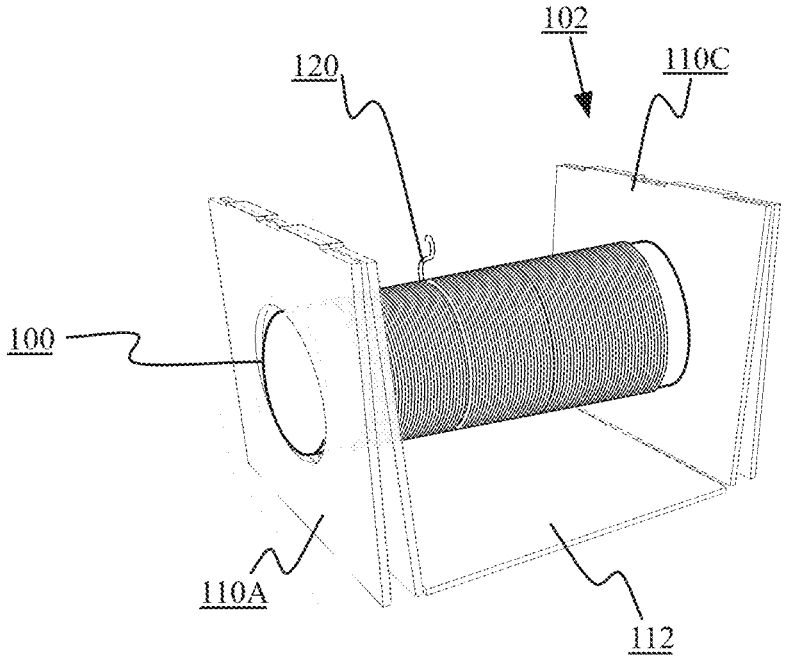
FIG. 1E is an illustration of an embodiment of the corrugated cable dispenser frame and core of FIGS. 1A-1D, integrated for use.

FIG. 1E is an illustration of an embodiment of the corrugated cable dispenser frame 102 and core 100 of FIGS. 1A-1D, integrated for use. As shown, the axle portions 122 of core 100 may be inserted through holes 104 of panels 110, such that the panels 110 support the core 100 with two degrees of freedom (e.g. horizontal transversal, and axial rotation). The cable 120 may be pulled from the dispenser while core 100 rotates axially, supported by panels 110 of frame 102. To prevent horizontal motion of the core (and frame), in many implementations, the frame and core combination (with cable installed) may be installed within a surrounding storage box or container, discussed in more detail below. The box may be similarly constructed of cardboard, corrugated cardboard, fiber board, kraft board, paper board, or other such materials, and may be lightweight, as it may need to provide only minimal structural strength.

Figure 2A:
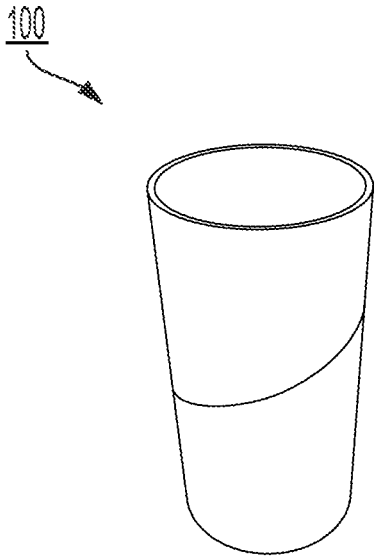
FIG. 2A is a photo of an embodiment of a core of a corrugated cable dispenser.
Figure 2B:
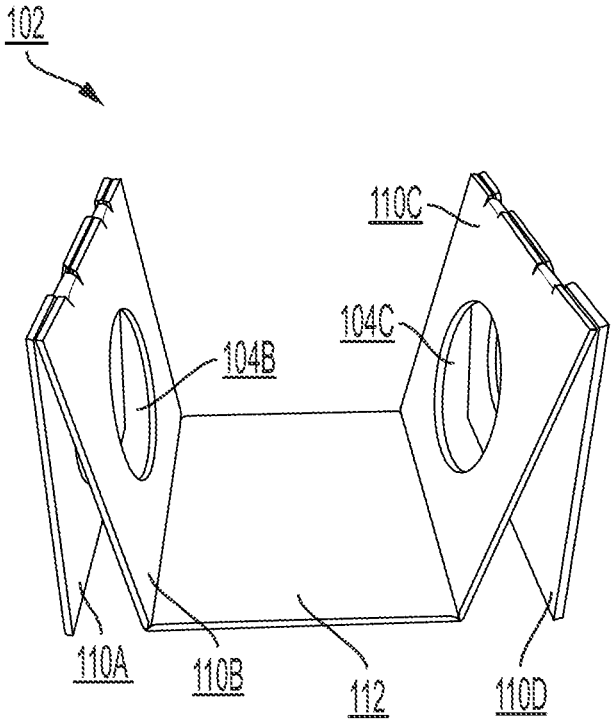
FIG. 2B is a photo of an embodiment of a frame of a corrugated cable dispenser, folded for use.
Figure 2C:
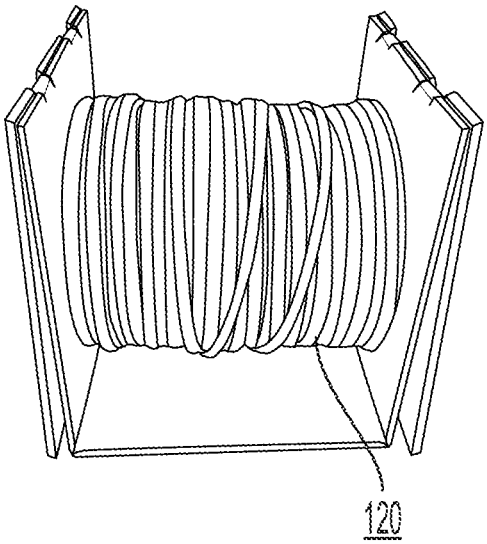
FIGS. 2C and 2D are photos of an embodiment of the corrugated cable dispenser frame and core of FIGS. 2A-2B integrated for use.
Figure 2D:
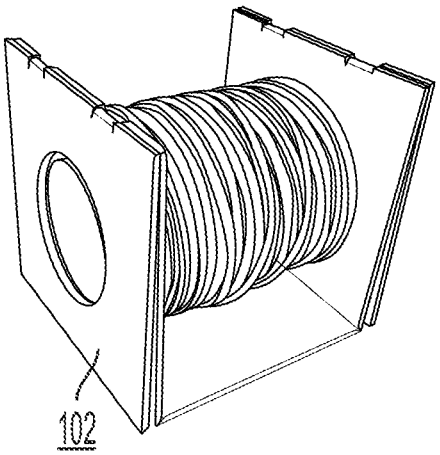
Figure 2E:
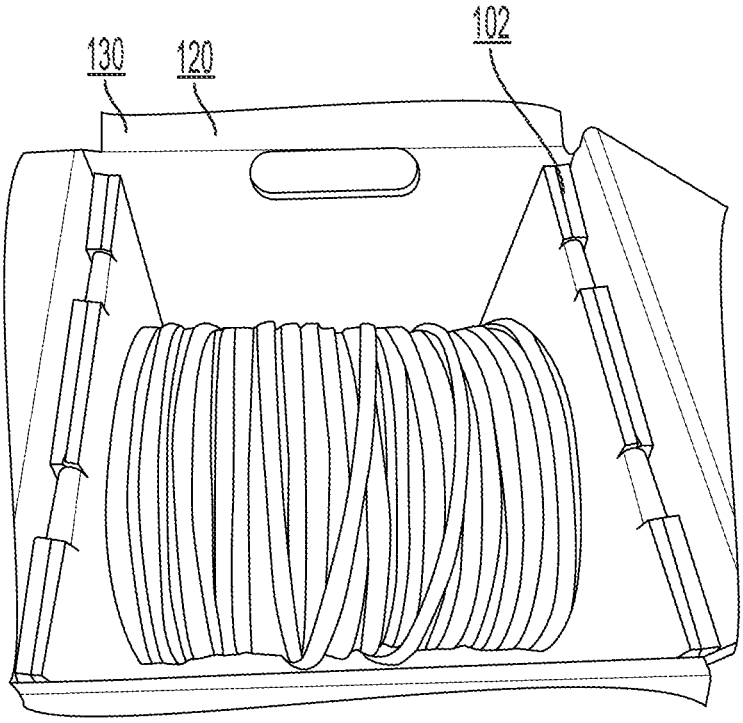
FIG. 2E is a photo of an embodiment of the corrugated cable dispenser of FIGS. 2C and 2D including a storage box.

For illustrative purposes, photos of one implementation of a cable dispensing system are provided in FIGS. 2A-2E. Although shown constructed of cardboard and paperboard with a jacketed cable, other cables and materials may be used as discussed above. FIG. 2A is a photo of an embodiment of a core 100 of a corrugated cable dispenser. FIG. 2B is a photo of an embodiment of a frame 102 of a corrugated cable dispenser, folded for use. FIGS. 2C and 2D are photos of an embodiment of the corrugated cable dispenser frame and core of FIGS. 2A-2B integrated for us, with installed cable 120. FIG. 2E is a photo of an embodiment of the corrugated cable dispenser of FIGS. 2C and 2D including a storage box 130, as discussed above.

In another implementation, the frame may be provided in two parts that may be joined together during assembly via an interlocking mechanism. Such implementations may provide additional stability for holding a tube and/or cable in place within a carton or during assembly. Such two-part implementations may also provide additional strength for the overall package. Implementations may be substantially symmetrical, allowing reversal during assembly (or being agnostic to unintentional reversal) and/or allowing cable dispensing from the top and/or bottom of the carton.

Figure 3A:
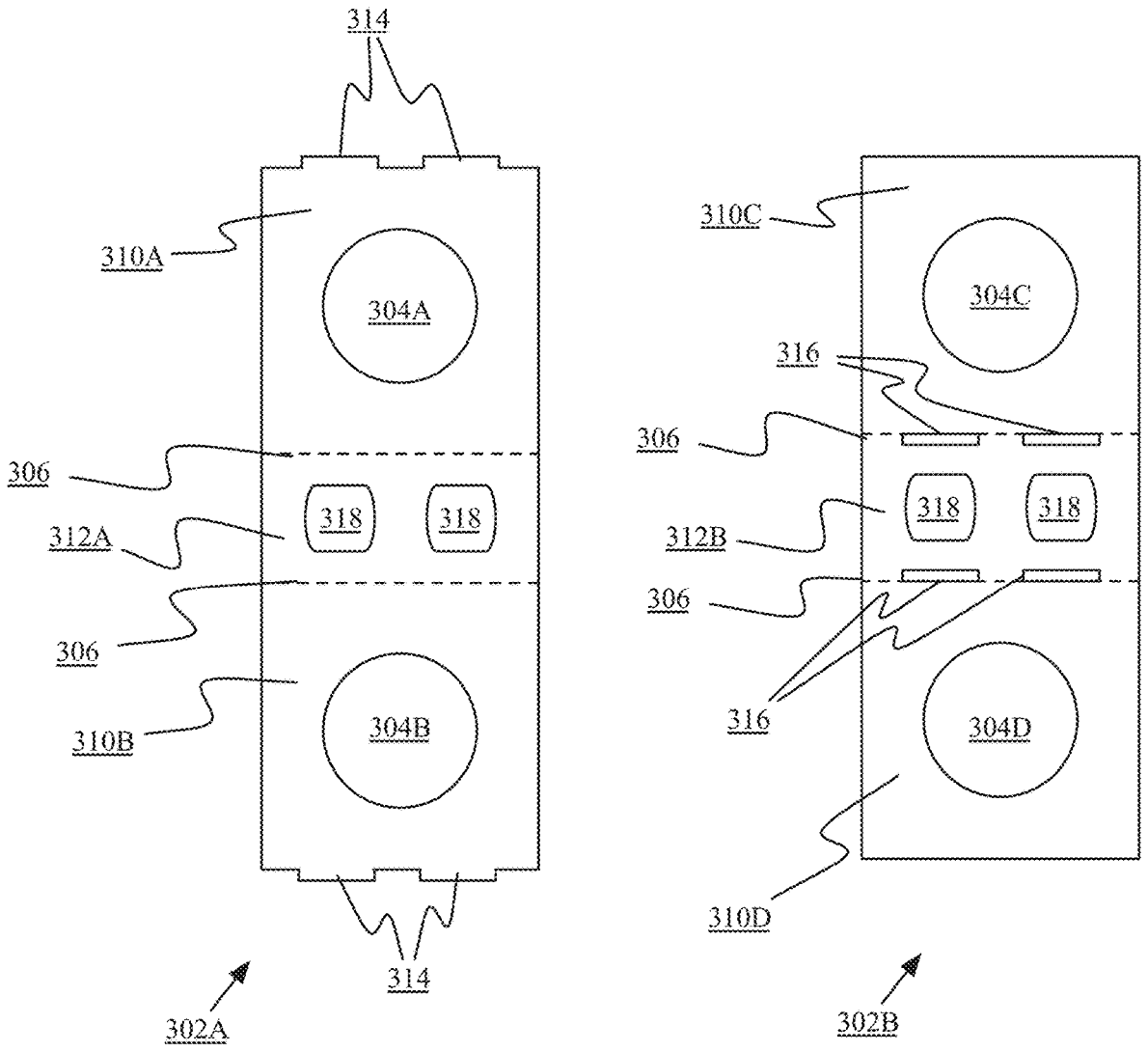
FIG. 3A is an illustration of another embodiment of a frame of a corrugated cable dispenser, unfolded.

FIG. 3A is an illustration of one such embodiment of a frame of a corrugated cable dispenser, unfolded, and separated with two parts or subframes (e.g. 302A, 302B) to be interlocked. As shown, each subframe may comprise three panels (e.g. side panel 310A, base panel 312A, and side panel 310B; or side panel 310C, base panel 312B, and side panel 310D). Side panels 310A-310D may be similar to panels 110A-110D discussed above, each including a corresponding hole or aperture 304A-304D similar to hole(s) 104, and similarly sized to support a core 100. Hole(s) 304 may be similarly cut from panel(s) 310 via a die cutting operation, laser cutting operation, or similar operation. Side panel(s) 310 and base panel(s) 312 may join at fold(s) 306. Similar to fold(s) 106, fold(s) 306 may comprise cutouts, perforations, or similar hinge mechanisms to facilitate folding of each part of the frame.

A first subframe 302A may comprise a plurality of tabs 314 protruding from side panel(s) 310A, 310B as shown. Corresponding slots 316 may be cut in a second subframe 302B to accommodate tabs 314 during assembly. As shown, each slot 316 may be positioned on base panel 312B of second subframe 302B adjacent to a fold 306. During assembly, first subframe 302A may be folded at folds 306 such that side panels 310A-310B are parallel to each other and perpendicular to base panel 312A. Similarly, second subframe 302B may be folded at folds 306 such that side panels 310C-310D are parallel to each other and perpendicular to base panel 312B. The first subframe 302A may be inverted and interlocked with second subframe 302B with tabs 314 inserted into slots 316, such that side panel 310A is adjacent to side panel 310D, and side panel 310B is adjacent to side panel 310C (similarly aligning apertures 304A, 304D; and 304B, 304C).

Although shown with tabs 314 on first subframe 302A, and slots 316 in second subframe 302B, in some implementations, the first subframe 302A may incorporate slots 316 while the second subframe incorporates tabs 314. In a still further implementation, each subframe 302A, 302B may include a combination of slots 316 and tabs 314 (e.g. two slots and two tabs on each subframe 302A, 302B, to interlock with corresponding tabs and slots on the opposing subframe). Although two pairs of two tabs 314 and two slots 316 are shown, in some implementations, a greater or fewer number of tabs and slots may be utilized (e.g. two pairs of three tabs and three slots, four tabs and four slots, etc.). As with apertures 304, slots 316 may be cut from panel(s) 310 via a die cutting operation, laser cutting operation, or similar operation.

As shown, in many implementations, base panel 312A may be slightly narrower than base panel 312B (e.g. by approximately twice the thickness of each side panel) so that the first subframe 302A may be inserted into the second subframe 302B while side panels 310A-310D remain parallel. In another implementation, the base panels 312 may be identical in width, with the two subframes 302A, 302B configured to be interlocked such that a first side panel of a first subframe is outside of the corresponding side panel of the second subframe, with a second side panel of the first subframe inside of the corresponding side panel of the other subframe. In some such implementations, each panel may have a combination of tabs and slots (e.g. such that the panels to the inside of the assembled frame include tabs to fit in corresponding slots of the base panels).

Either or both of base panels 312A, 312B may include one or more cutouts 318 for dispensing cable from a core when the cable dispenser is assembled. Cutouts 318 may be of any suitable shape and size, and may be rectangular as shown, circular, oval, or any other such shape. Once assembled, a cable may be withdrawn from the dispenser through a cutout 318. Although shown symmetrically positioned on each base panel, in some implementations, cutouts 318 may be asymmetrically positioned.

Figure 3B:
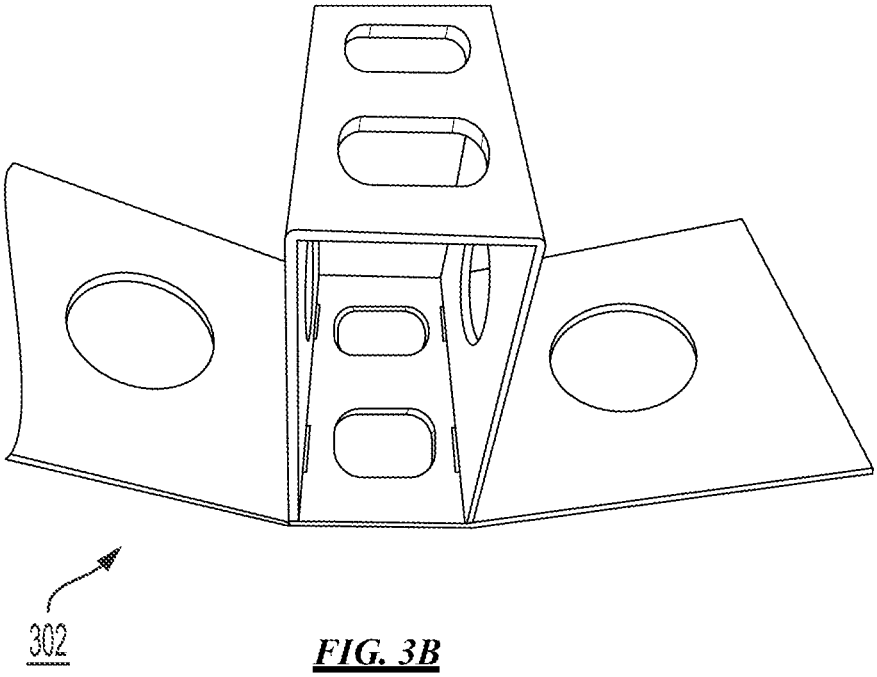
FIGS. 3B and 3C are photos showing an embodiment of assembly of the corrugated cable dispenser frame of FIG. 3A.
Figure 3C:
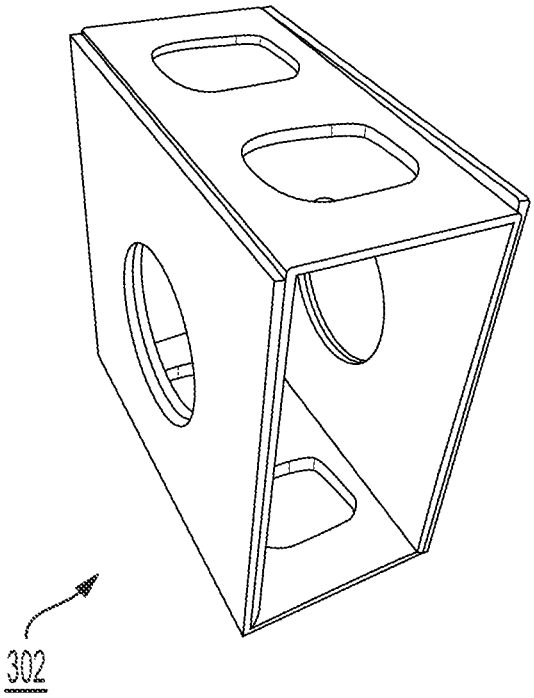

FIGS. 3B and 3C are photos showing an embodiment of assembly of the corrugated cable dispenser frame of FIG. 3A. As shown in FIG. 3B, a first subframe may be folded with side panels parallel to each other and orthogonal to the base panel; and tabs of the first subframe side panels may be inserted in corresponding slots of the base panel of the second subframe. The side panels of the second subframe may then be folded parallel to each other (and to side panels of the first subframe), as shown in FIG. 3C. In some implementations, adhesives or other fastening means may be applied to maintain the shape of the folded frame (e.g. tape, glue, staples, etc.).

Figure 3D:
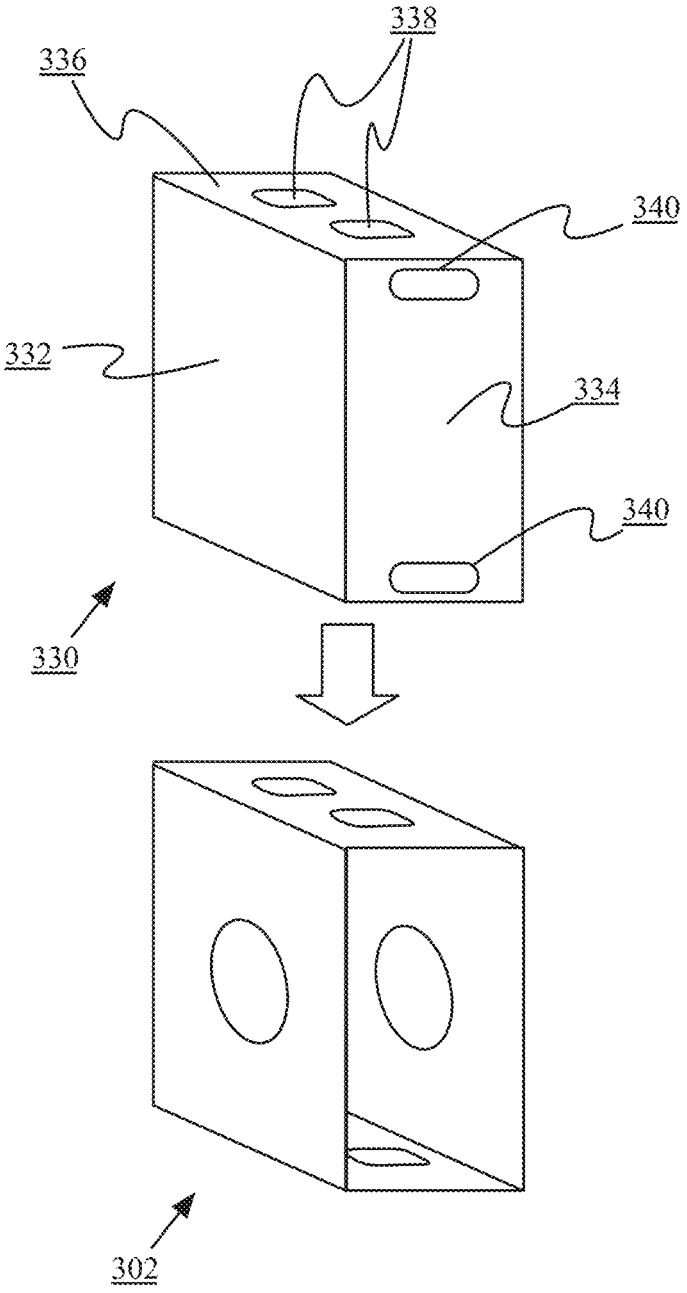
FIG. 3D is an illustration of an embodiment of an enclosing carton for a corrugated cable dispenser frame.

FIG. 3D is an illustration of an embodiment of an enclosing carton 330 for a corrugated cable dispenser frame. Although shown with frame 302, in some implementations, carton 330 may be used with frame 102. As shown, the assembled frame 302 may be inserted into the carton 330 (or the carton lowered to encapsulate the frame). Carton 330 may have six sides, and be folded to enclose the frame after insertion. A cable reel or core 100 may be inserted into the frame 302 during assembly (not illustrated).

Carton 330 may include side panels 332, 334, and top panel 336 (as well as rear side panels and a bottom panel, not illustrated). In some implementations, top panel 336 (and optionally, the bottom panel) may include cutouts 338 corresponding to cutouts 318. A cable wound on a core 100 may be withdrawn through a cutout 318 and corresponding cutout 338 for dispensing. In many implementations, cutouts 338 may not be fully cut, but rather may be perforated to allow a user to remove a desired cutout.

In some implementations, one or more holes or handles 340 may be positioned on a front panel 334 of a carton 330 (including on a rear panel 334, not illustrated). A handle 340 may comprise a rectangular, rounded rectangular, or oval cutout, sized such that a user may insert their fingers or thumb into the carton to lift or grip the carton. In some implementations, a cutout 338 may be positioned such that a user may reach through both cutout 338 and handle 340 simultaneously, providing a more ergonomic and stronger grip on carton 330. Once assembled, the portion of the carton between handle 340 and an adjacent cutout 338 may be adjacent to corresponding portions of frame 302 (e.g. between cutout 318 and an edge of the base panel 312), providing three layers of corrugated cardboard for a user's hand to grip. Such implementations may prevent tearing of the cardboard at the relatively short span between the cutout 338 and handle 340 and provide a stronger support than a single layer of corrugated cardboard.

Figure 3E:
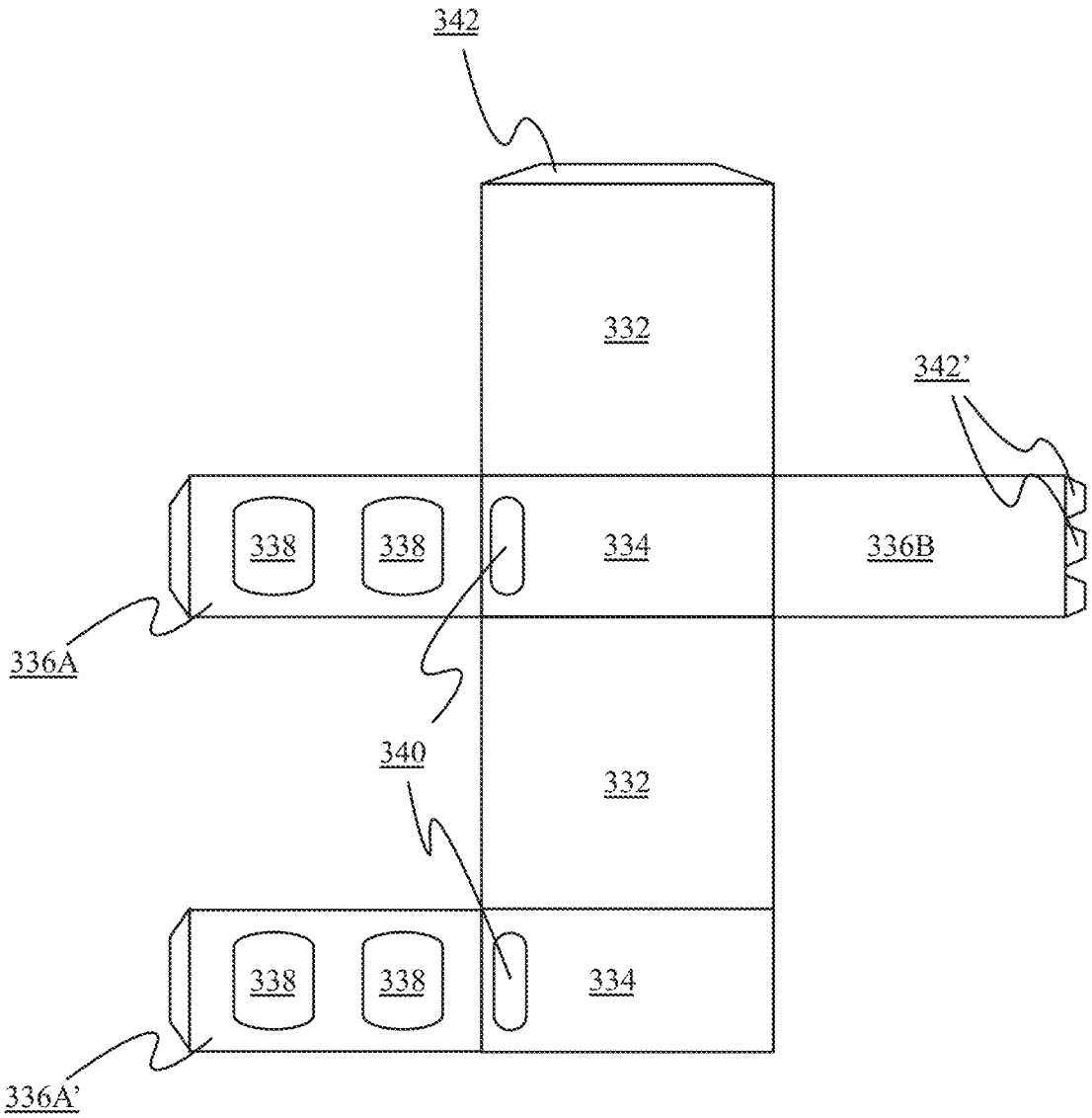
FIG. 3E is an illustration of an embodiment of an enclosing carton for a corrugated cable dispenser frame, unfolded.

FIG. 3E is an illustration of an embodiment of an enclosing carton for a corrugated cable dispenser frame, unfolded. In some implementations, the carton may have more than six panels. For example, as shown, some implementations of the carton may include a single bottom panel 336B, and two top panels 336A, 336A'. When folded into a rectangular prism, top panels 336A, 336A' may be parallel and adjacent to each other, with holes 338 aligned, sometimes referred to as a 'full overlap top'. Such implementations may provide additional strength, particularly to a grip via holes 338 and handles 340 which may then include four layers of corrugated cardboard.

Although shown with seven panels, in various implementations, an eighth panel (e.g. a second bottom panel 336B attached to side panel 332) may be utilized to provide a full overlap bottom for additional structural strength. Similarly, in some implementations, bottom panel(s) 336B may include holes 338 for dispensing cable from the bottom of the carton. Front and rear panels 334 may similarly include additional handles 340 at an edge adjacent to bottom panel (s) 336B when folded. Likewise, while illustrated with top and bottom panels 336A, 336A', 336B attached to front and rear panels 334, in some implementations, other formations may be employed (e.g. with top and bottom panels attached to side panels 332).

In many implementations, each panel may include one or more tabs, slots, or extensions 342 to facilitate attachment to a neighboring panel. For example, a first panel may include a tab 342 attached to a side of the panel that may be folded and glued or otherwise adhered to another panel (e.g. panel 334, once folded into a rectangular prism), during assembly. In many implementations, a plurality of tabs 342 may be employed attached to a corresponding plurality of panels. As shown, in some implementations, a single tab 342 may have a width equal to that of the corresponding panel (e.g. tab 342 and panel 332); while in other implementations, the tab may be divided into a plurality of smaller tabs or subtabs (e.g. tab 342' attached to panel 336B). In some implementations, tabs 342 may be trapezoidal, as shown; or may be other shapes (e.g. rectangular, triangular, etc.).

Figure 3F:
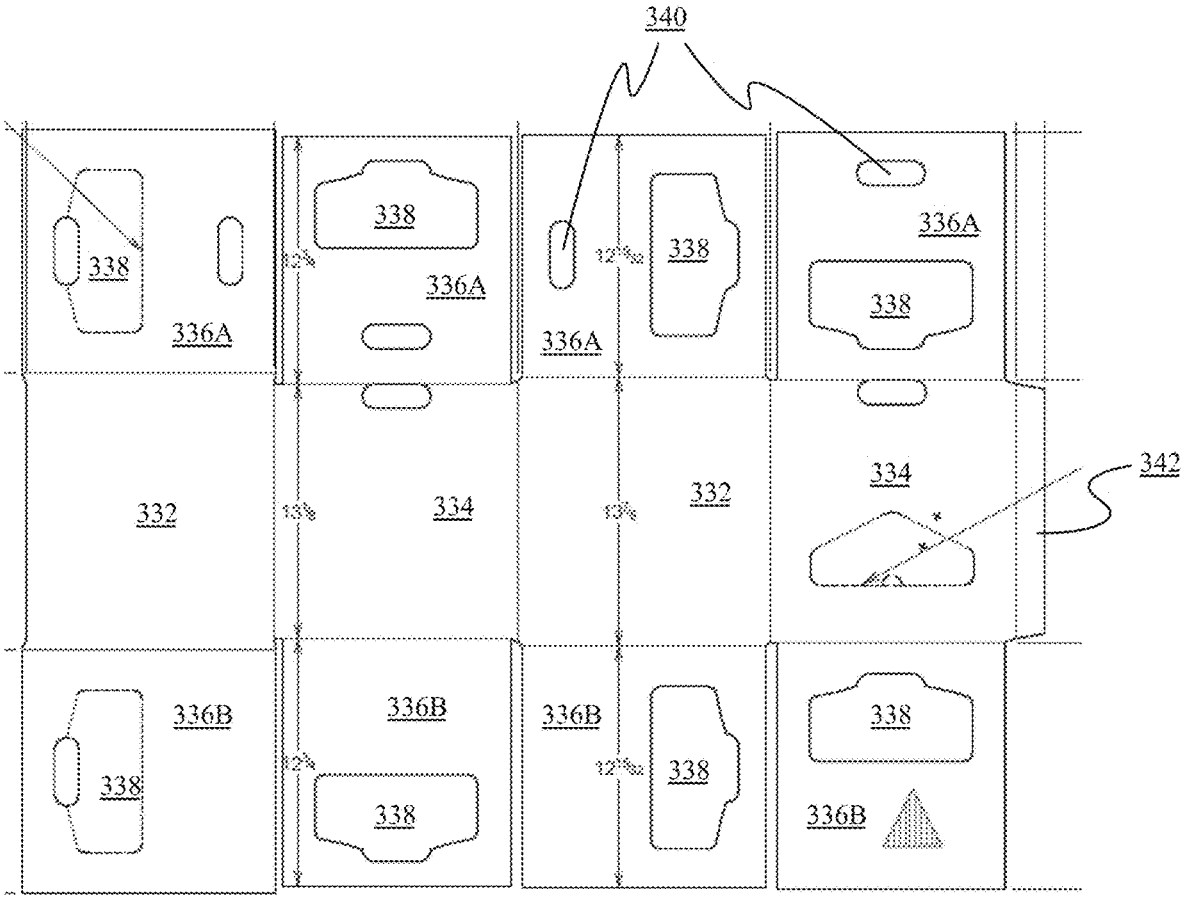
FIG. 3F is an illustration of another embodiment of an enclosing carton for a corrugated cable dispenser frame, unfolded.

FIG. 3F is an illustration of another embodiment of an enclosing carton for a corrugated cable dispenser frame, unfolded. In some implementations, the carton may include a number of panels configured to be folded adjacent to each other, providing additional structural strength. For example, as shown, in some implementations, the carton may include 12 panels consisting of two side panels 332, a back panel 334A and front panel 334B, and two sets of four panels (336A, 336B) for the top and bottom of the carton. Holes or cutouts in the two sets of four panels (e.g. cutouts 338, 340) may be arranged to have corresponding adjacent positions when the carton is folded for use.

Thus, in many implementations, the cable dispenser may be lightweight, inexpensive to manufacture, and easily recyclable as in box-based systems, while providing the benefits of strength and easy deployment without tangling of reel-based systems, without requiring additional flanges, reel stands, or other such heavy and expensive components.

In one aspect, the present disclosure is directed to a cable dispenser. The cable dispenser includes a first subframe, comprising: a first panel comprising a first hole having a first diameter and at least one tab; a second panel orthogonal to the first panel and attached to the first panel at a first edge of the second panel; and a third panel orthogonal to the second panel and parallel to the first panel and attached to the second panel at a second edge of the second panel, opposite the first edge of the second panel and separated from the first edge of the second panel by a first width, the third panel comprising a second hole having the first diameter and a second at least one tab. The cable dispenser also includes a second subframe, comprising: a fourth panel comprising a third hole having the first diameter; a fifth panel orthogonal to the fourth panel and attached to the fourth panel at a first edge of the fifth panel and comprising a plurality of slots, each slot configured to receive a corresponding tab of the at least one tabs of the first panel or the at least one tabs of the third panel; and a sixth panel orthogonal to the fifth panel and parallel to the fourth panel and attached to the fifth panel at a second edge of the fifth panel opposite the first edge of the fifth panel and separated from the first edge of the fifth panel by a second width greater than the first width, the sixth panel comprising a fourth hole having the first diameter. The cable dispenser also includes a cylindrical core, positioned within the first hole and the second hole of the first subframe and the third hole and fourth hole of the second subframe, and having an outer diameter approximately equal to the first diameter and a length equal to or greater than the first width and second width such that when positioned within the first hole, the second hole, the third hole, and the fourth hole, the core has one rotational degree of freedom and one transversal degree of freedom. The cable dispenser also includes a carton comprising a plurality of panels configured to encapsulate the first subframe, the second subframe, and the cylindrical core, a first panel of the plurality of panels of the carton having at least one rounded rectangular hole sized to accommodate a human hand. The first panel of the first subframe is adjacent to the fourth panel of the second subframe, the third panel of the first subframe is adjacent to the sixth panel of the second subframe, and the second panel of the first subframe is parallel to the fifth panel of the second subframe.

In some implementations of the cable dispenser, the first subframe, the second subframe, and the carton are corrugated cardboard. In some implementations of the cable dispenser, the cylindrical core is compressed paper. In some implementations, the cable dispenser comprises a cable helically wrapped around the cylindrical core. In a further implementation, the cylindrical core comprises a first axel region at a first terminal end of the cylindrical core positioned within the first hole and the third hole, a second axel region at a second terminal end of the cylindrical core positioned within the second hole and the fourth hole, and a central portion between the first axel region and second axel region; and wherein the cable is helically wrapped around the central portion.

In some implementations of the cable dispenser, the second panel of the first subframe includes at least one cutout configured to receive a terminal end of a cable wrapped around the cylindrical core. In a further implementation, a second panel of the carton includes at least one cutout adjacent to the at least one cutout of the second panel of the first subframe and configured to receive the terminal end of the cable. In some implementations, a seam between the first panel of the first subframe and the second panel of the subframe is folded approximately 90 degrees. In some implementations, a seam between the first panel of the first subframe and the second panel of the subframe is perforated. In some implementations, the at least one rounded rectangular hole of the first panel of the carton has perforated edges and a removable central portion.

In another aspect, the present disclosure is directed to another implementation of a cable dispenser. The cable dispenser includes a frame comprising: a first panel comprising a first hole having a first diameter; a second panel orthogonal to the first panel and attached to the first panel at a first edge of the second panel; and a third panel orthogonal to the second panel and parallel to the first panel and attached to the second panel at a second edge of the second panel, opposite the first edge of the second panel and separated from the first edge of the second panel by a first width, the third panel comprising a second hole having the first diameter. The cable dispenser includes a cylindrical core, positioned within the first hole and the second hole of the frame, and having an outer diameter approximately equal to the first diameter and a length equal to or greater than the first width such that when positioned within the first hole and the second hole, the core has one rotational degree of freedom and one transversal degree of freedom.

In some implementations, the frame is corrugated cardboard. In some implementations, the frame further comprises: a fourth panel, parallel to and attached to the first panel and comprising a third hole having the first diameter; and a fifth panel, parallel to and attached to the third panel and comprising a fourth hole having the first diameter; and the cylindrical core is positioned within the third hole and the fourth hole. In a further implementation, the fourth panel is attached to the first panel by a first hinge, and the fifth panel is attached to the third panel by a second hinge. In a still further implementation, the first hinge and second hinge each comprise one or more cutouts in the frame separating attachment portions between adjacent panels.

In some implementations, the frame comprises: a first subframe comprising the first panel, the second panel, and third panel; and a second subframe comprising: a fourth panel comprising a third hole having the first diameter, a fifth panel orthogonal to the fourth panel and attached to the fourth panel at a first edge of the fifth panel, and a sixth panel orthogonal to the fifth panel and parallel to the fourth panel and attached to the fifth panel at a second edge of the fifth panel opposite the first edge of the fifth panel and separated from the first edge of the fifth panel by a second width equal to or greater than the first width, the sixth panel comprising a fourth hole having the first diameter. In a further implementation, the first subframe and the second subframe comprise a plurality of interlocking portions. In a still further implementation, the plurality of interlocking portions of the first subframe and the second subframe comprise a plurality of tabs attached to a second edge of the first panel and a corresponding plurality of slots in the fifth panel.

In some implementations, the cable dispenser includes a carton comprising a plurality of panels configured to encapsulate the frame and the cylindrical core. In a further implementation, a first panel of the plurality of panels of the carton comprises at least one hole sized to accommodate a human hand.

In another aspect, the present disclosure is directed to another implementation of a cable dispenser. The cable dispenser includes a frame comprising a plurality of attached panels, a subset of the plurality of attached panels each comprising a hole having a first diameter; and a core having an outer diameter approximately equal to the first diameter, the core positioned within the holes of at least two panels of the subset of the plurality of attached panels.

In some implementations, the frame is formed of a single material. In some implementations, the frame comprises a first panel having a first hole, a second panel attached to the first panel, and a third panel attached to the second panel having a second hole. In some implementations, the core has one rotational degree of freedom when positioned within the holes of the at least two panels of the subset of the plurality of attached panels.

In some implementations, the frame further comprises a first subframe having a first plurality of attached panels, and a second subframe having a second plurality of attached panels, a subset of each of the first plurality of attached panels and the second plurality of attached panels each comprising a hole having the first diameter. In a further implementation, the first subframe is positioned within the second subframe such that a hole of a first panel of the first subframe is adjacent to a hole of a first panel of the second subframe. In another further implementation, the first subframe is attached to the second subframe via an attachment with one degree of freedom.

In some implementations, a second subset of the plurality of attached panels, different from the first subset of the plurality of attached panels, comprises a hole for dispensing a cable from the core. In some implementations, the cable dispenser includes a carton comprising a plurality of panels configured to encapsulate the frame and the cylindrical core. In a further implementation, a first panel of the plurality of panels of the carton comprises at least one hole sized to accommodate a human hand.

The above description in conjunction with the above-reference drawings sets forth a variety of embodiments for exemplary purposes, which are in no way intended to limit the scope of the described methods or systems. Those having skill in the relevant art can modify the described methods and systems in various ways without departing from the broadest scope of the described methods and systems. Thus, the scope of the methods and systems described herein should not be limited by any of the exemplary embodiments and should be defined in accordance with the accompanying claims and their equivalents.

What is claimed:

1. A cable dispenser, comprising:

a first subframe, comprising:

a first panel comprising a first hole having a first diameter and at least one tab, a second panel orthogonal to the first panel and attached to the first panel at a first edge of the second panel, and a third panel orthogonal to the second panel and parallel to the first panel and attached to the second panel at a second edge of the second panel, opposite the first edge of the second panel and separated from the first edge of the second panel by a first width, the third panel comprising a second hole having the first diameter and a second at least one tab;

a second subframe, comprising:

a fourth panel comprising a third hole having the first diameter, a fifth panel orthogonal to the fourth panel and attached to the fourth panel at a first edge of the fifth panel and comprising a plurality of slots, each slot configured to receive a corresponding tab of the at least one tabs of the first panel or the at least one tabs of the third panel, and a sixth panel orthogonal to the fifth panel and parallel to the fourth panel and attached to the fifth panel at a second edge of the fifth panel opposite the first edge of the fifth panel and separated from the first edge of the fifth panel by a second width greater than the first width, the sixth panel comprising a fourth hole having the first diameter;

a cylindrical core, positioned through the first hole and the second hole of the first subframe and the third hole and fourth hole of the second subframe, and having an outer diameter approximately equal to the first diameter and a length equal to or greater than the first width and second width such that when positioned through the first hole, the second hole, the third hole, and the fourth hole, the core has one rotational degree of freedom and one transversal degree of freedom; and a carton comprising a plurality of panels configured to encapsulate the first subframe, the second subframe, and the cylindrical core, a first panel of the plurality of panels of the carton having at least one rounded rectangular hole sized to accommodate a human hand;

wherein the first panel of the first subframe is adjacent to the fourth panel of the second subframe, the third panel of the first subframe is adjacent to the sixth panel of the second subframe, and the second panel of the first subframe is parallel to the fifth panel of the second subframe.

2. The cable dispenser of claim 1, wherein the first subframe, the second subframe, and the carton are corrugated cardboard.

3. The cable dispenser of claim 1, wherein the cylindrical core is compressed paper.

4. The cable dispenser of claim 1, further comprising a cable helically wrapped around the cylindrical core.

5. The cable dispenser of claim 4, wherein the cylindrical core comprises a first axel region at a first terminal end of the cylindrical core positioned within the first hole and the third hole, a second axel region at a second terminal end of the cylindrical core positioned within the second hole and the fourth hole, and a central portion between the first axel region and second axel region; and wherein the cable is helically wrapped around the central portion.

6. The cable dispenser of claim 1, wherein the second panel of the first subframe includes at least one cutout configured to receive a terminal end of a cable wrapped around the cylindrical core.

7. The cable dispenser of claim 6, wherein a second panel of the carton includes at least one cutout adjacent to the at least one cutout of the second panel of the first subframe and configured to receive the terminal end of the cable.

8. The cable dispenser of claim 1, wherein a seam between the first panel of the first subframe and the second panel of the subframe is folded approximately 90 degrees.

9. The cable dispenser of claim 1, wherein a seam between the first panel of the first subframe and the second panel of the subframe is perforated.

10. The cable dispenser of claim 1, wherein the at least one rounded rectangular hole of the first panel of the carton has perforated edges and a removable central portion.

11. A cable dispenser, comprising:

a frame comprising:

a first subframe comprising:

a first panel comprising a first hole having a first diameter, a second panel orthogonal to the first panel and attached to the first panel at a first edge of the second panel, and a third panel orthogonal to the second panel and parallel to the first panel and attached to the second panel at a second edge of the second panel, opposite the first edge of the second panel and separated from the first edge of the second panel by a first width, the third panel comprising a second hole having the first diameter; and a second subframe comprising:

a fourth panel comprising a third hole having the first diameter, a fifth panel orthogonal to the fourth panel and attached to the fourth panel at a first edge of the fifth panel, and a sixth panel orthogonal to the fifth panel and parallel to the fourth panel and attached to the fifth panel at a second edge of the fifth panel opposite the first edge of the fifth panel and separated from the first edge of the fifth panel by a second width equal to or greater than the first width, the sixth panel comprising a fourth hole having the first diameter; and a cylindrical core, positioned within the first hole and the second hole of the frame, and having an outer diameter approximately equal to the first diameter and a length equal to or greater than the first width such that when positioned within the first hole and the second hole, the core has only one rotational degree of freedom and only one transversal degree of freedom.

12. The cable dispenser of claim 11, wherein the frame is corrugated cardboard.

13. The cable dispenser of claim 11, wherein the first subframe and the second subframe comprise a plurality of interlocking portions.

14. The cable dispenser of claim 13, wherein the plurality of interlocking portions of the first subframe and the second subframe comprise a plurality of tabs attached to a second edge of the first panel and a corresponding plurality of slots in the fifth panel.

15. The cable dispenser of claim 11, further comprising a carton comprising a plurality of panels configured to encapsulate the frame and the cylindrical core.

16. The cable dispenser of claim 15, wherein a first panel of the plurality of panels of the carton comprises at least one hole sized to accommodate a human hand.

17. A cable dispenser, comprising:

a frame comprising a plurality of attached panels, a subset of the plurality of attached panels each comprising a hole having a first diameter; and a core having an outer diameter approximately equal to the first diameter, the core positioned within the holes of at least two panels of the subset of the plurality of attached panels;

wherein the frame further comprises a first subframe having a first plurality of attached panels, and a second subframe having a second plurality of attached panels, a subset of each of the first plurality of attached panels and the second plurality of attached panels each comprising a hole having the first diameter; and wherein the first subframe is positioned within the second subframe such that a hole of a first panel of the first subframe is adjacent to a hole of a first panel of the second subframe.

18. The cable dispenser of claim 17, wherein the first subframe is attached to the second subframe via an attachment with one transversal degree of freedom.

* * * * *